US008377078B2

(12) United States Patent
Kindermann et al.

(10) Patent No.: US 8,377,078 B2
(45) Date of Patent: Feb. 19, 2013

(54) EPILATOR WITH INTERCHANGEABLE CAPS

(75) Inventors: Sebastian Alexander Kindermann, Klagenfurt (AT); Ingo Muller, Klagenfurt (AT); Johann Rogatschnig, Velden (AT); Erich Potscher, Ferndorf (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 206 days.

(21) Appl. No.: 12/741,041

(22) PCT Filed: Feb. 16, 2009

(86) PCT No.: PCT/IB2009/050619

§ 371 (c)(1),
(2), (4) Date: May 3, 2010

(87) PCT Pub. No.: WO2009/104124

PCT Pub. Date: Aug. 27, 2009

(65) Prior Publication Data

US 2010/0262163 A1 Oct. 14, 2010

(30) Foreign Application Priority Data

Feb. 22, 2008 (EP) ..... 08151784

(51) Int. Cl.
*A61B 17/50* (2006.01)
*A45D 26/00* (2006.01)

(52) U.S. Cl. ..... 606/133

(58) Field of Classification Search ..... 606/131, 606/133; 30/32, 34.2, 43.4, 43.5, 537, 539; 452/102–104, 75, 82–85
See application file for complete search history.

(56) References Cited

U.S. PATENT DOCUMENTS

| | | | | | |
|---|---|---|---|---|---|
| 4,960,422 | A | * | 10/1990 | Demeester | 606/133 |
| 5,356,415 | A | * | 10/1994 | Iwasaki et al. | 606/133 |
| 5,810,843 | A | * | 9/1998 | Iwasaki et al. | 606/133 |
| 5,893,854 | A | * | 4/1999 | Bontoux et al. | 606/133 |
| 5,916,222 | A | * | 6/1999 | Iwasaki et al. | 606/133 |
| 5,980,452 | A | * | 11/1999 | Garenfeld et al. | 600/133 |
| 6,004,331 | A | * | 12/1999 | Takeuchi et al. | 606/133 |
| 6,165,182 | A | * | 12/2000 | Caric et al. | 606/133 |
| 6,176,862 | B1 | * | 1/2001 | Delay et al. | 606/133 |
| D447,282 | S | * | 8/2001 | Yiu | D28/44.1 |
| 6,277,129 | B1 | | 8/2001 | Poran | |
| 6,471,712 | B2 | * | 10/2002 | Burres | 606/131 |
| D482,821 | S | * | 11/2003 | Seifert | D28/44.1 |
| 6,669,704 | B2 | * | 12/2003 | Inoue et al. | 606/133 |
| 6,740,097 | B1 | * | 5/2004 | Sanchez-Martinez | 606/133 |
| 6,824,546 | B1 | * | 11/2004 | Yiu | 606/133 |
| D510,460 | S | * | 10/2005 | Kling | D28/44.1 |
| D511,589 | S | * | 11/2005 | Kling et al. | D28/44.1 |

(Continued)

FOREIGN PATENT DOCUMENTS

| | | |
|---|---|---|
| EP | 0807388 A1 | 11/1997 |
| WO | 9603063 A1 | 2/1996 |

(Continued)

*Primary Examiner* — Elizabeth Houston

(57) ABSTRACT

An epilator having at least two interchangeable attachments each having a different skin contact surface which defines the position of the skin relative to the epilating member when the attachment is mounted onto the epilator. According to the present system, each attachment has a coupling by which the attachment can be coupled to a driver of the epilator for vibrating the attachment.

14 Claims, 9 Drawing Sheets

U.S. PATENT DOCUMENTS

| | | | | | |
|---|---|---|---|---|---|
| D512,186 | S | * | 11/2005 | Kling | D28/54 |
| D530,449 | S | * | 10/2006 | Kling | D28/44.1 |
| D530,858 | S | * | 10/2006 | Kling | D28/54 |
| 7,479,137 | B2 | * | 1/2009 | Yamazaki et al. | 606/9 |
| 7,540,088 | B2 | * | 6/2009 | Takeshita | 30/34.2 |
| 7,582,094 | B2 | * | 9/2009 | Dorber et al. | 606/133 |
| 2005/0080432 | A1 | * | 4/2005 | Fertner et al. | 606/133 |
| 2008/0040935 | A1 | * | 2/2008 | Gratz | 30/539 |
| 2009/0071006 | A1 | * | 3/2009 | Bruno | 30/34.2 |
| 2009/0071007 | A1 | * | 3/2009 | Bruno | 30/34.2 |

FOREIGN PATENT DOCUMENTS

| | | | |
|---|---|---|---|
| WO | 9719613 | A1 | 6/1997 |
| WO | 2004054401 | A1 | 7/2004 |
| WO | 2007068363 | A1 | 6/2007 |

* cited by examiner

EPILATOR WITH INTERCHANGEABLE CAPS

FIELD OF THE INVENTION

The invention relates to an epilator comprising at least two interchangeable attachments each having a different skin contact surface which defines the position of the skin relative to an epilating member when the attachment is mounted onto the epilator.

BACKGROUND OF THE INVENTION

The purpose of an epilator is to epilate skin, i.e. to remove hair from the skin by pulling it out. An epilator may comprise supplementary tools for modifying the characteristics of its epilating function or for providing functions other than epilation, such as vibrating the skin to alleviate pain, massaging the skin after epilation, and peeling the skin for removing ingrown hair.

Various methods of alleviating pain caused by extracting hair from the skin are known in the art.

WO 2004/054401 A1 describes an epilator of the type mentioned above. This epilator can comprise different attachments designed to cover different percentages of an epilating member in order to more or less reduce the epilation rate and thereby the pain level.

An alternative way of alleviating pain consists in stimulating nerves in the skin immediately before and while the hair is pulled out, as described in EP 0808 114 B1 and references therein. To this end, EP 0808 114 B1 proposes a vibrating member arranged next to the epilating member.

It is an object of the invention to further develop an epilator of the type mentioned in the opening paragraph, such that it comprises attachments with different skin contact surfaces as well as means for stimulating the nerves in the skin so as to effectively alleviate pain.

This object is achieved by the characteristic features defined in claim 1. Further specifications and preferred embodiments of the invention are outlined in the dependent claims.

SUMMARY OF THE INVENTION

According to the invention, each attachment has a coupling means by which the attachment can be coupled to a driving means of the epilator for vibrating the attachment. In contrast to the obvious solution of the above object to provide both, i.e. attachments known from WO 2004/054401 A1 and an additional vibrating member known from EP 0808 114 B1, the present invention solves the above object of effectively alleviating pain without increasing the number of necessary parts. According to the invention, each attachment can be vibrated, which eliminates the need for an additional vibrating member. The attachments may be driven by the motor that also drives the epilating member, or by an additional motor that is exclusively used to drive the attachments, or by a combination of both. Advantageously, the epilator comprises a hand piece which is ergonomically shaped so that a user may comfortably maneuver the epilator relative to his or her skin. Each attachment may be mounted onto the hand piece directly or by means of a connecting piece such as a mounting frame.

In accordance with a preferred embodiment, the epilator comprises a first hinge member for reversibly engaging with a second hinge member provided at each attachment. This allows a pivoting motion with respect to the hand piece of the attachment mounted onto the hand piece, wherein the inclination of the attachment relative to the hand piece and thus to the skin oscillates within a small angular range. The hinge defines a rotational axis which preferably extends parallel to the skin. The motion of the attachment is preferably such that its inclination with respect to the hand piece varies by less than 4° and more preferably by less than 2°. A user of the epilator experiences the pivoting of the attachment as a vibration on his or her skin. The hinge elements of the hand piece and the attachment may be a mount and an axle, respectively, or vice versa.

Each attachment may comprise an elastic part designed to be deformed by the driving means of the epilating unit during a first phase of a driving cycle and to relax during a second phase of the driving cycle. A forced vibration of the surface of the attachment is thereby achieved.

The driving means of the epilator may comprise an eccentric rotatable tappet. A segment of the circumference of the tappet preferably contacts the attachment that has been mounted onto the hand piece. Due to its eccentricity, rotation of the tappet induces a cyclic motion of the attachment (or of a movable part thereof) with respect to the hand piece. Alternatively or additionally, the driving means may comprise a piston.

Advantageously, at least one attachment is an injection-molded part. This allows the attachment to be particularly robust and to be produced in a particularly simple manner. The attachment is preferably a single injection-molded part. Each attachment is preferably an injection-molded part.

The epilator may comprise a mounting frame having means for engaging with either the first or the second attachment by means of a snap mechanism, the mounting frame further holding the epilating member and being reversibly detachable from the hand piece. The mounting frame thus serves as an intermediate part connecting the attachment to the hand piece. The mounting frame is preferably an injection-molded part.

The skin contact surfaces of at least two attachments may differ in elasticity. For example, the skin contact surface of an attachment for massaging skin is advantageously more elastic (that is, more compliant) than the skin contact surface of an attachment for providing pain relief by vibrations.

The skin contact surfaces of at least two attachments may differ in texture. For example, they may be smooth for epilation of sensitive areas and rough for skin-peeling, respectively.

The skin contact surfaces of at least two attachments may differ in shape. In particular, they may differ as to the extent to which they cover the epilating member. The skin contact surface of at least one attachment may comprise an array of protrusions, whereas the skin contact surface of at least another attachment does not comprise any protrusions. Advantageously, the protrusions are shaped so as to stimulate nerves in the skin for the purpose of pain relief.

The skin contact surface of at least one of the attachments may cover the epilating member at least partially. The skin contact surface thus prevents a portion of the epilating member from contacting the skin, thereby reducing the pain level. The skin contact surface of at least one of the attachments may cover the epilating member completely. In this case, the skin contact surface disables the epilating function of the epilator and may provide, for example, a massaging or a peeling function.

The skin contact surface of at least one attachment may surround the epilating member. The skin contact surface thus prevents a circumference of the epilating member from contacting the skin.

The skin contact surface of at least one attachment may be arranged on one side of the epilating member. The epilator is thereby made asymmetric with respect to the directions of movement, i.e. its epilating characteristics will depend on the direction in which the epilator is moved over the skin.

The skin contact surface of at least one attachment may have a rough texture for peeling skin. In this context, the skin contact surface preferably covers the epilating member completely.

These and other aspects of the invention are apparent from and will be elucidated with reference to the embodiments described hereinafter.

DESCRIPTION OF EMBODIMENTS

Figure 1A:
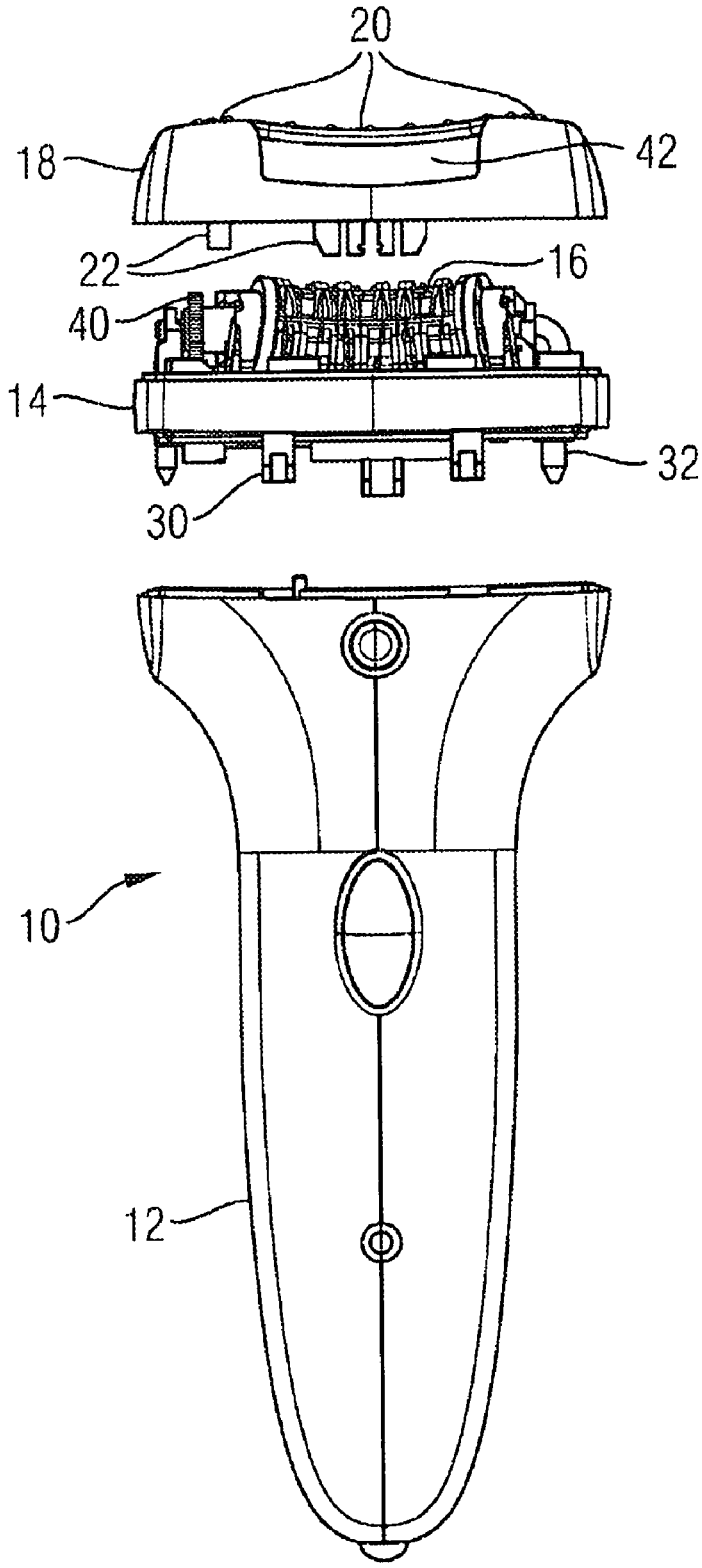
FIGS. 1*a-e* are exploded views from different perspectives of an epilating unit and an attachment according to the invention.
Figure 1B:
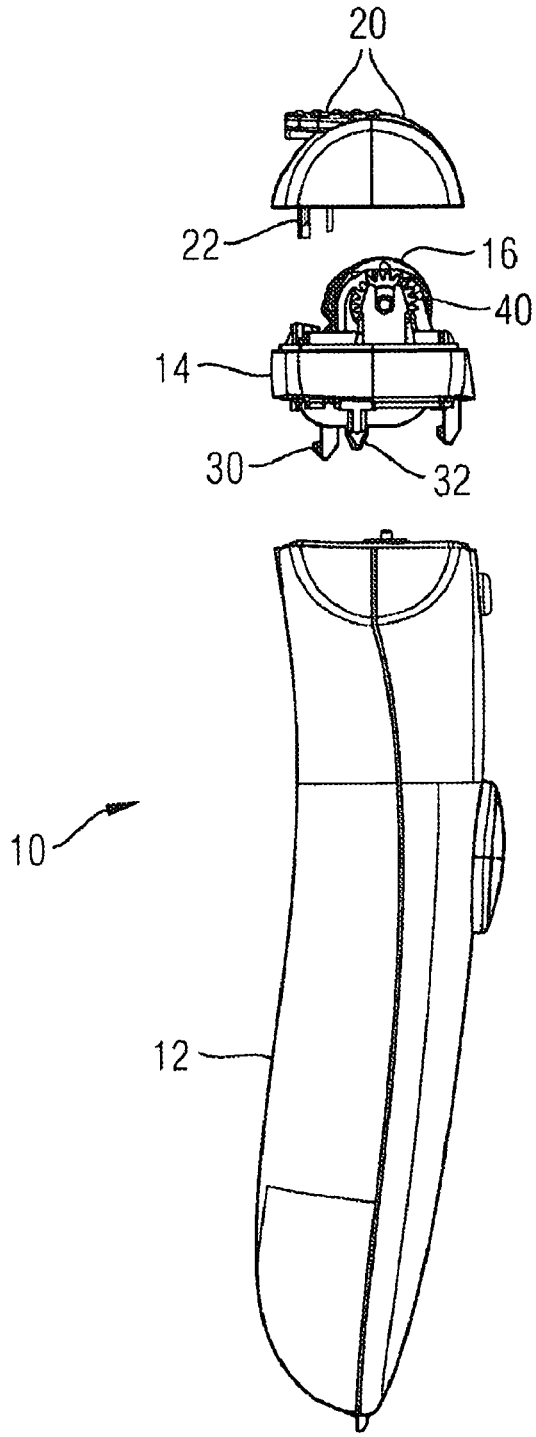
Figure 1C:
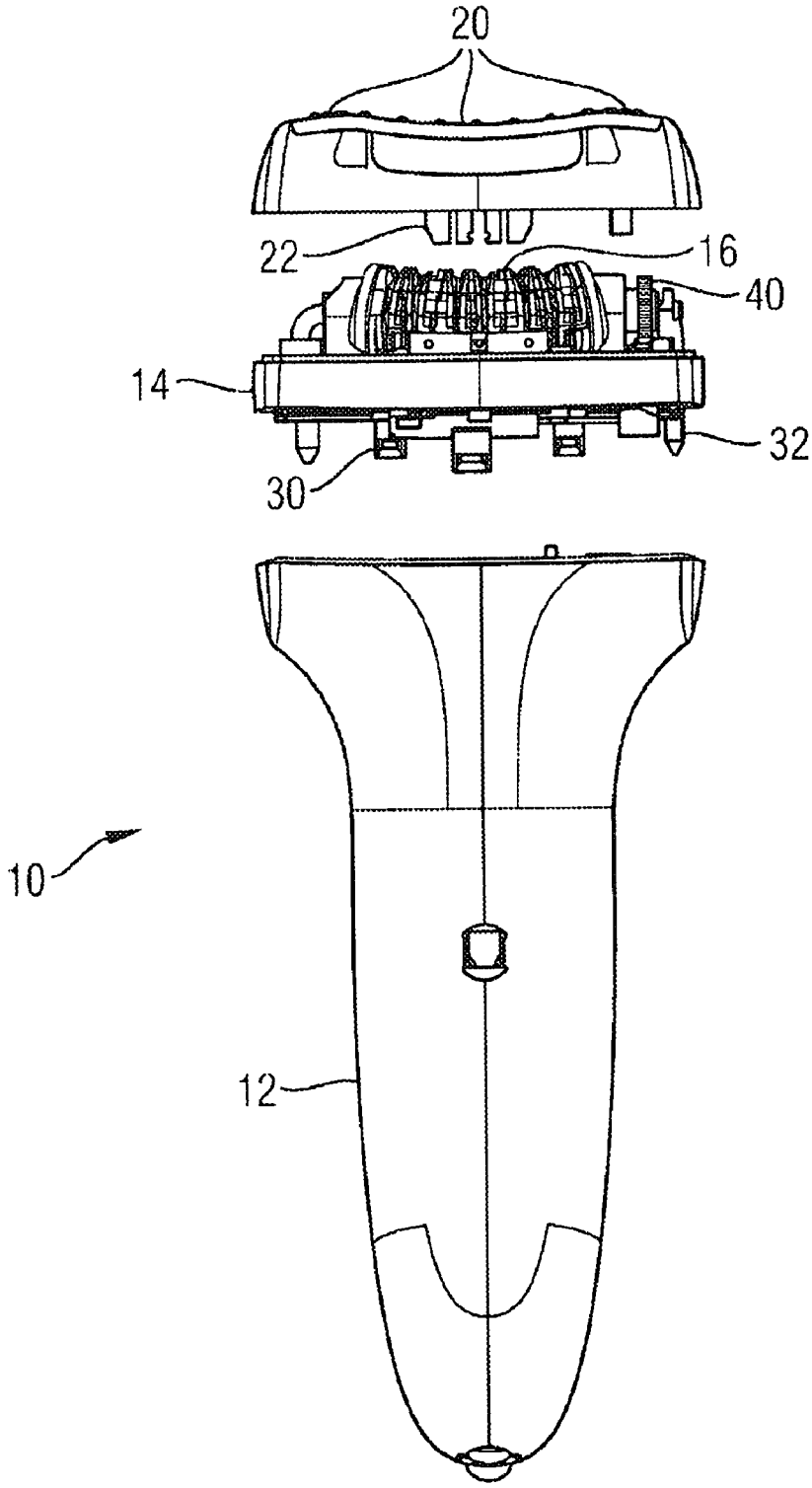
Figure 1E:
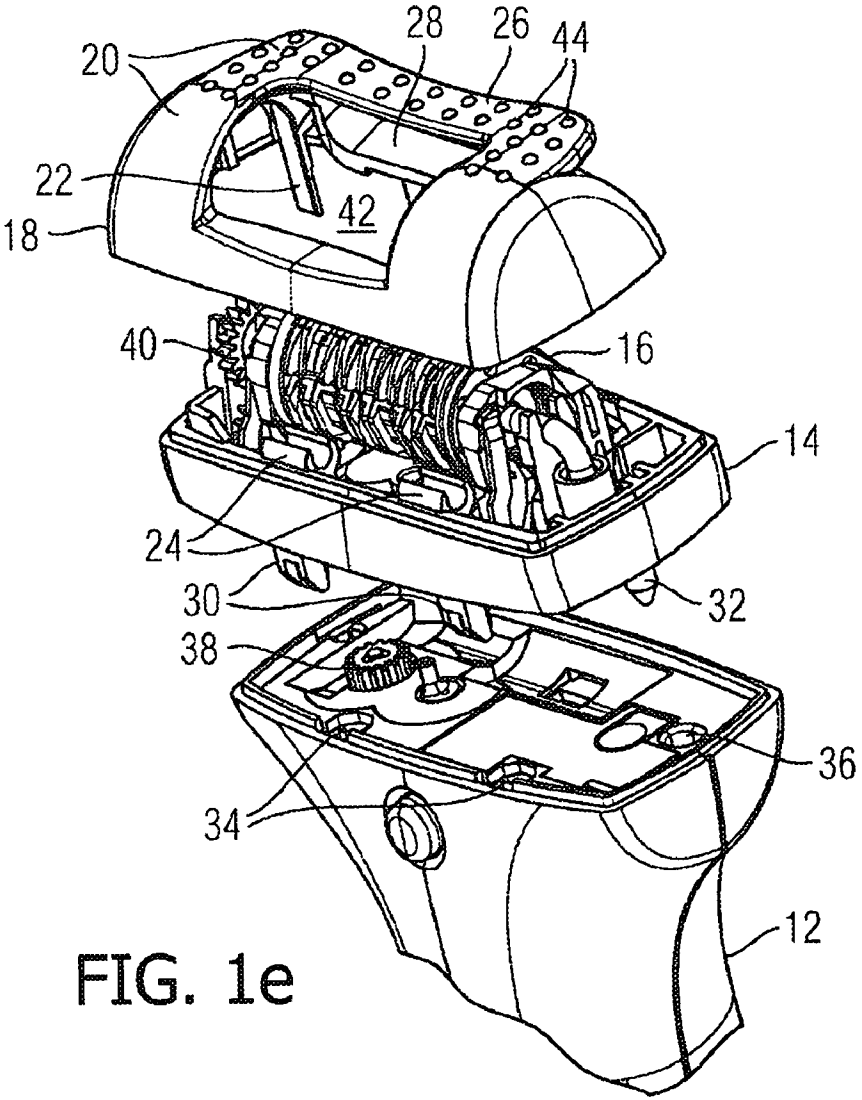
Figure 1D:
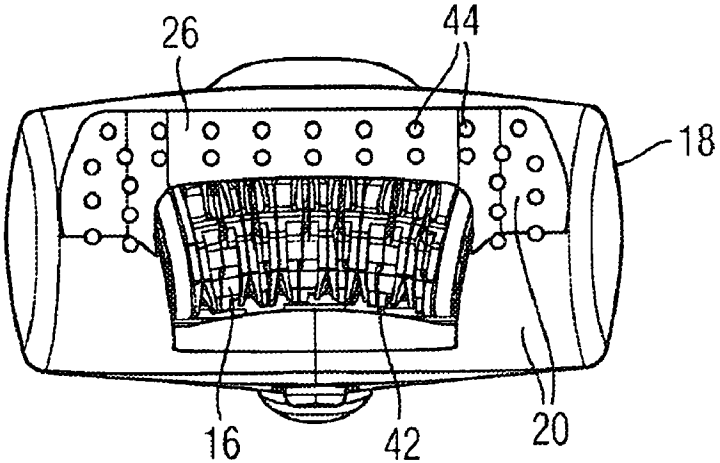

Similar or analogous features appearing in different Figures are designated by the same reference numerals and are not necessarily described more than once.

FIGS. 1*a-e* are a front, side, back, top, and skew-angle view, respectively, of an epilator according to the invention. The epilator comprises an epilating unit 10 and an attachment 18. The epilating unit 10 comprises a hand piece 12, a mounting frame 14, and an epilating member 16 for gripping and removing hair from the human skin. The hand piece 12 comprises a housing accommodating an electric motor (not visible in the Figures) for driving the epilating member 16. The epilating member 16 is mounted on the mounting frame 14. In the present embodiment, the epilating member 16 comprises pairs of co-operating clamping discs which are driven via a gearwheel 40 mounted on the mounting frame 14. However, the epilating member may be of any type known in the art. The portion of the epilating member 16 that is designed to contact the skin for gripping hairs is referred to as the active epilation area of the epilating member. In the embodiment shown, the active epilation area thus consists of the surface defined by the outer circumferences of the clamping discs and more precisely the portion thereof that would contact the skin if the epilating unit were used without an attachment. The mounting frame 14, with the epilating member 16 attached to it, may be connected to and disconnected from the hand piece 12 by a user without using any tools. To this end, the mounting frame comprises pinnacle-like protrusions 30, 32 which are shaped so as to mate with complementary recesses 34, 36 (see FIG. 1*e*) on top of a mounting plate of the hand piece 12 and provide a snap connection between the mounting frame 14 and the hand piece 12. Temporary removal of the mounting frame 14 together with the epilating member 16 from the hand piece 12 may be convenient for cleaning the epilating member 16. An attachment 18 is removably attachable to the mounting frame 14. In the embodiment shown, the attachment 18 is a Vibration Cap which, when attached to the mounting frame 14, surrounds the base and side portions of the epilating member 16, thereby providing a barrier between the epilating member 16 and the skin and thus defining the position of the skin relative to the epilating member 16 during an epilation procedure. The mounting frame 14 and the Vibration Cap 18 are designed in such a way that a pivoting motion is imparted to the Vibration Cap 18 via a coupling mechanism (described below with reference to FIGS. 5*a-b*) which is operably connected to a driving wheel 38 (see FIG. 1*e*) of the hand piece 12. The surface of the Vibration Cap has a surface 20 designed to contact the skin. The Vibration Cap 18 has the general shape of a hollow semicylinder, the surface of which has a substantially rectangular opening 42 through which the epilating member 16 may contact the skin. The opening 42 and a carrier portion 28 of the attachment are bridged by a flat vibration bar 26 extending parallel to the principal axis of the semicylinder defined by the Vibration Cap 18. The upper surface of the vibration bar 26 comprises a two-dimensional array of identical small conical or hemispheric protrusions 44 for provoking vibrational sensations on the skin when the Vibration Cap 18 is pivoted at a sufficiently high frequency so as to briefly anaesthetize the part of the skin that is to be epilated. To this end, the user of the epilator needs to move the epilator over his or her skin in such a direction that the active epilation area succeeds the vibration bar 26 in its motion over the skin, thereby ensuring that, before being epilated, the skin is at least partially anaesthetized by the vibration bar 26. The vibration bar 26 also forces the user to hold the epilating unit 10 perpendicular to the skin. At its base, the attachment 18 has vertical protrusions 22 protruding downward beyond the base and designed to engage complementary recesses (not indicated in the Figures) on the upper side of the mounting frame 14 so as to fasten the attachment 18 to the mounting frame 14 by means of a snap mechanism. At its base, the attachment 18 further has a pair of axles (not visible) designed to reversibly engage a complementary pair of mounts 24 on the mounting frame 14 so as to form a hinge. By means of the protrusions 22 and mounts 24 and their complementary members, the Vibration Cap, such as the Caps to be described below, thus engages the mounting frame 14 on two opposite sides of the epilating member 16.

Figure 2B:
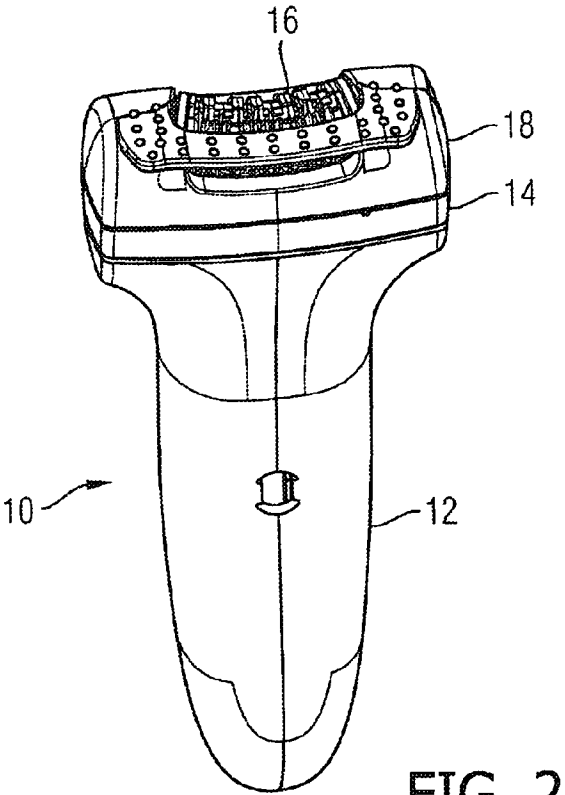
FIGS. 2*a*, 2*b* show the attachment attached to the epilating unit shown in FIGS. 1*a-e*.
Figure 2A:
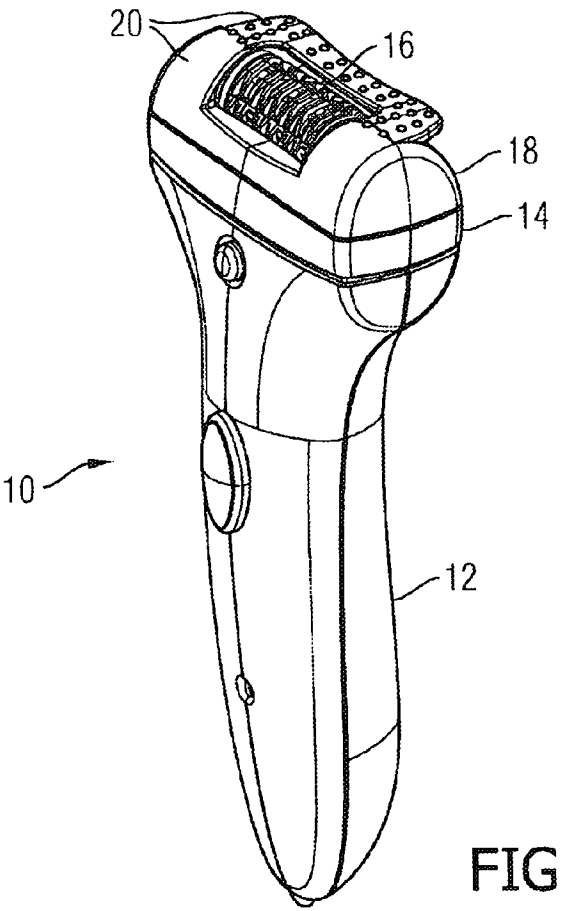

FIGS. 2*a* and 2*b* show the epilating unit 10 with the Vibration Cap 18 attached as described with reference to FIGS. 1*a-e*.

FIGS. 3*a-d* schematically illustrate four different attachments 18 which can be removably and interchangeably attached to the mounting frame 14 of the epilating unit 10 described with reference to FIGS. 1*a-e* and FIGS. 2*a-b*. In combination with the epilating unit 10, each attachment provides a distinct function selected from the following group of functions: preventing part of the active epilation area from contacting skin, anaesthetizing skin, massaging skin, and peeling skin. By exchanging two attachments, i.e. by first removing a first attachment (e.g. the attachment shown in FIG. 3*a*) from the epilating unit 10 and then attaching a second attachment (e.g. the attachment shown in FIG. 3*b*), the functionality of the epilator is modified in a simple manner.

Figure 3A:
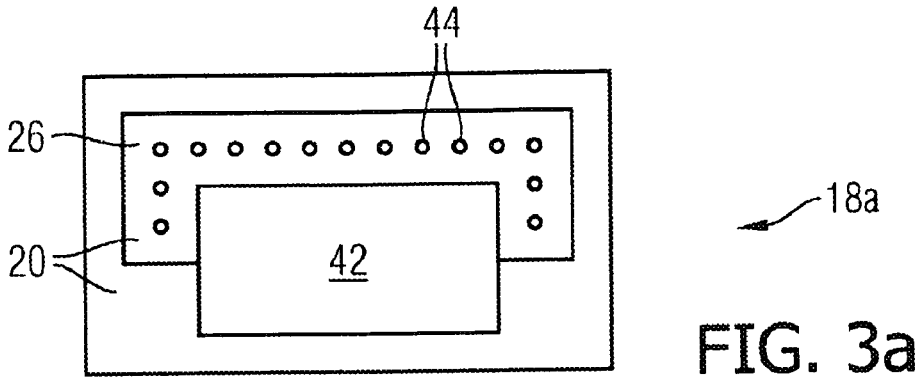
FIGS. 3*a-d* are schematic top views of different embodiments of an attachment according to the invention.

FIG. 3*a* is a schematic top view of the Vibration Cap 18*a* described above with reference to FIGS. 1*a-e* and 2*a-b*. The Vibration Cap 18*a* has a skin contact surface 20 for generating an alleviating vibrational sensation on the skin, with part of the skin contact surface 20 being provided by a vibration bar 26 which is dotted with hemispheric protrusions 44. The length of the substantially rectangular opening 42 matches the length of the epilating member 16 (not visible in the Figure) of the epilating unit 10 (not visible in the Figure), allowing a high epilation rate. Due to its surrounding the epilating member, the Vibration Cap allows stimulating a larger surface of skin around the epilating member as compared to earlier devices which comprise a vibration member arranged next to the epilating member without surrounding the latter.

Figure 3B:
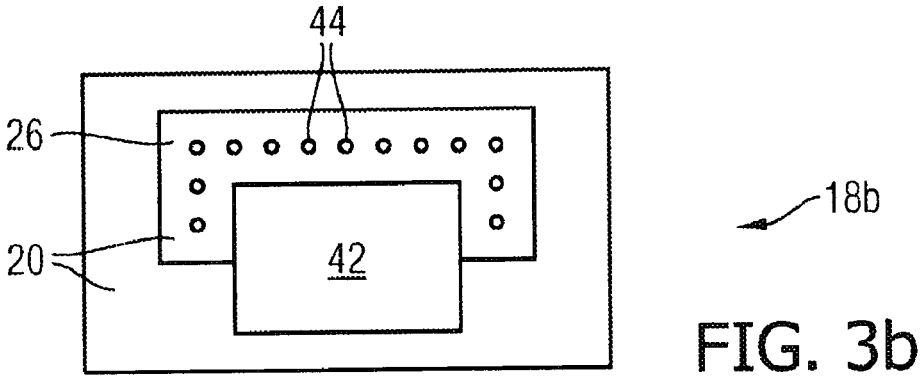

FIG. 3*b* is a schematic top view of an attachment in accordance with a second embodiment of the invention. The attachment 18*b* is a Starter Cap designed to help new users of the epilator become accustomed to pain caused by the epilation procedure. The Starter Cap 18*b* differs from the Vibration Cap 18*a* of FIG. 3*a* essentially in that its substantially rectangular opening 42 is shorter and thus smaller. The Starter Cap thus prevents a portion of the epilating member 16 from contacting the skin, resulting in a reduced epilation speed and a reduced pain level as compared to the Vibration Cap. In comparison with the Vibration Cap, the total time needed to epilate a given area of skin is longer when using the Starter Cap.

Figure 3C:
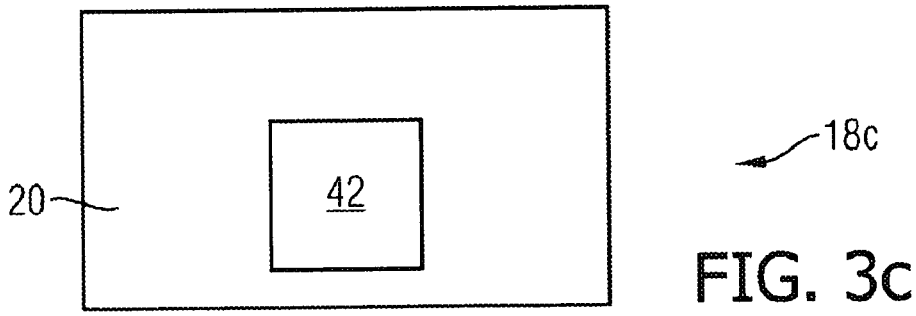

FIG. 3*c* is a schematic top view of an attachment in accordance with a third embodiment of the invention. The attachment is a Sensitive Cap 18*c* designed to epilate sensitive areas of the skin, for example, armpits. As compared to the Starter Cap shown in FIG. 3*b*, the opening 24 is further reduced and the Starter Cap thus prevents a larger portion of the epilating member 16 visible in FIGS. 1 and 2 from contacting the skin and resulting in an even lower epilation rate and even lower pain level. The Sensitive Cap does not have a vibration bar bridging the opening 42, because such a bar could be cumbersome when epilating skin on concave portions of the body, such as armpits. Both the small size of the opening 42 and the absence of a vibration bar make the Sensitive Cap particularly easy to maneuver on the skin.

Figure 3D:
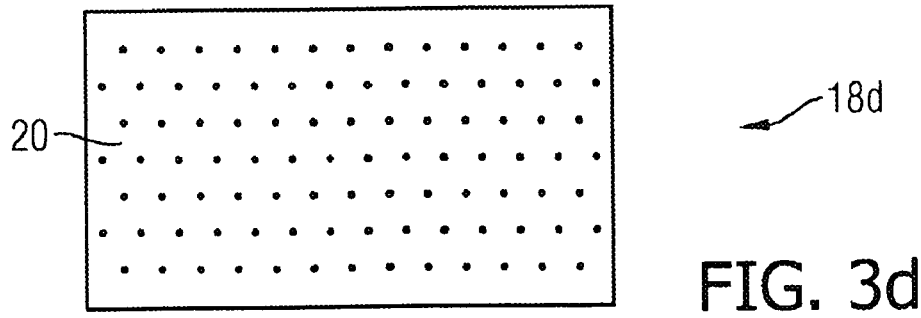

FIG. 3*d* is a schematic top view of an attachment in accordance with a fourth embodiment of the invention. The attachment is a Peeling Cap 18*d* designed to peel skin which has been epilated in a preceding step. In order to prevent ingrowths of hair in the skin after epilation, the skin should be peeled several times between consecutive epilation treatments so as to rub off dead skin and open the pores, thereby allowing new hair to grow out without problems. The Peeling Cap 18*d* covers the epilating member entirely and thus completely disables the epilating function of the epilator. Accordingly, the Peeling Cap 18*d* does not have an opening similar to the opening 42 shown in FIGS. 3*a-c*. The skin contact surface 20 of the Peeling Cap has a rough texture, as is indicated by the dots in the Figure, in order to provide the peeling function. The rough texture may be provided by means of sandpaper.

In accordance with a fifth embodiment of the invention, the attachment is a Massaging Cap (not shown), for massaging skin. The Massaging Cap is similar to the Peeling Cap in that it completely covers the epilating member. It differs from the Peeling Cap essentially in that it has a smooth surface and is made of a more compliant material.

Figure 4A:
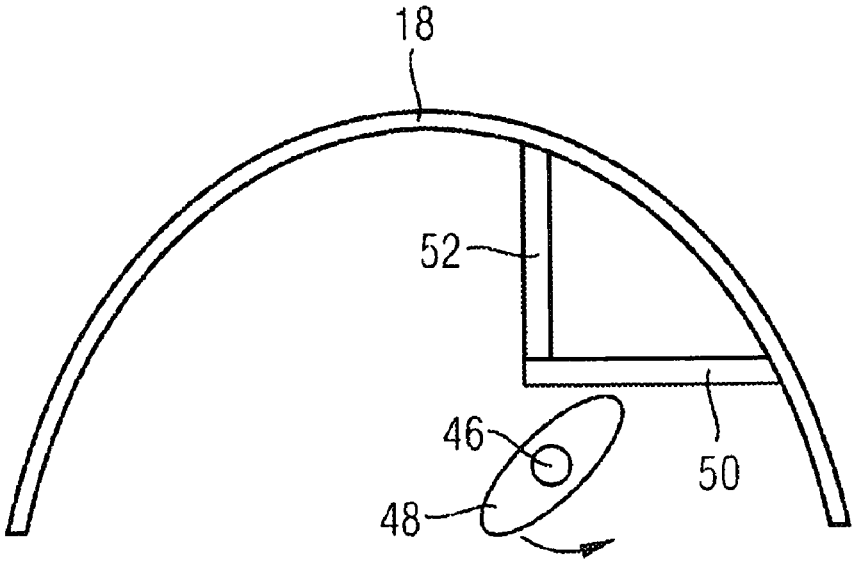
FIGS. 4*a*, 4*b* are schematic cut-away views of an attachment coupled to driving means of an epilating unit.
Figure 4B:
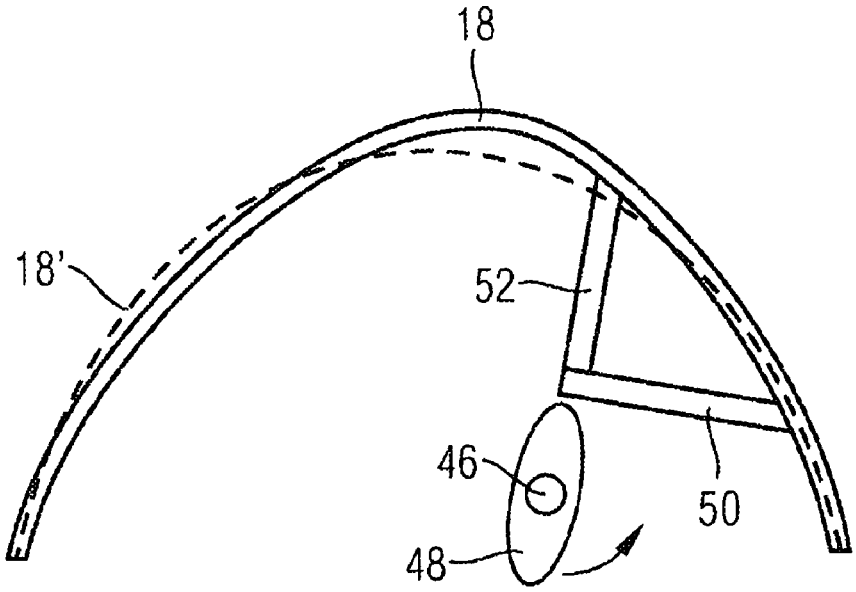

FIGS. 4*a* and 4*b* schematically illustrate a possible way of imparting a vibrational motion to an attachment 18 that has been mounted on an epilating unit (10 in the preceding Figures). An axle 46 is mounted onto a mounting frame (14 in the preceding Figures) of the epilating unit. This axle 46 supports an eccentric, preferably oval or elliptic tappet 48 which is rotatable about the axle. The axle 46 extends parallel to the principal axis of the attachment 18, the latter having the general shape of a hollow semicylinder. An elastic bar 50 protrudes horizontally from the inner surface of the hollow semicylinder into its interior. This elastic bar 50 is connected to another elastic bar 52 protruding vertically downward from the inner surface of the hollow semicylinder into its interior. Due to its eccentric shape, the tappet 48 bends the bar 50 twice during each revolution (FIG. 4*b*). Bending of the horizontal bar 50 causes, via the vertical bar 52, a deformation of the surface of the attachment 18. The attachment 18 is made of an elastic material so that it relaxes to its equilibrium shape 18' when the tappet has such an orientation that this relaxation is possible (FIG. 4*a*). The deformation of the surface of the attachment is experienced as a vibration by the user of the epilator, provided that the tappet rotates sufficiently rapidly. The vibrational frequency is related to the shape of the tappet and can be changed by changing the single tappet to a double tappet or a Reuleaux triangle. Alternatively or additionally, the attachment may comprise a spring ensuring or helping that the attachment 18 returns to its equilibrium shape.

Figure 5A:
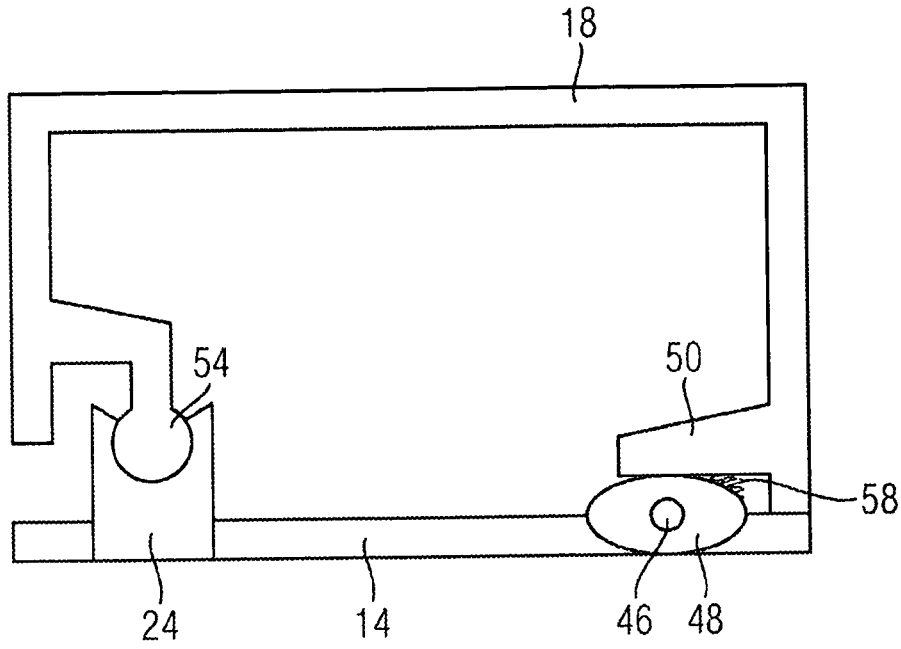
FIGS. 5*a*, 5*b* are schematic cut-away views of an attachment coupled to driving means of an epilating unit in accordance with a preferred embodiment.
Figure 5B:
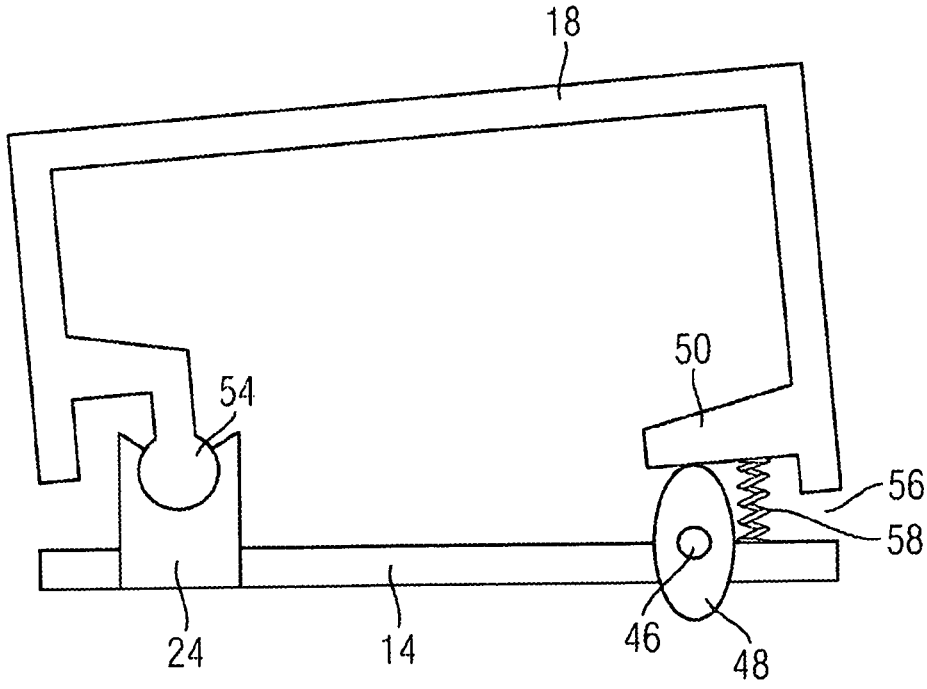

FIGS. 5*a* and 5*b* are schematic cut-away side views of an attachment 18 of an epilator, illustrating a preferred way of vibrating the attachment 18. Note that the Figures are simplistic. In particular, in an actual embodiment, those areas of the attachment that are to contact the skin are ergonomically rounded. The attachment 18 is attached to a mounting frame 14 of a hand piece (not shown) by means of a hinge 24, 54 defining a rotational axis which is perpendicular to the image plane of the Figures and about which the cap 18 is rotatable. The hinge 24, 54 is composed of an axle 54 forming a rigid part of the attachment 18 and a complementary mount 24 forming a rigid part of the mounting frame 14. The mount 24 partially surrounds and thereby holds the axle 54. Also mounted to the mounting frame 14 is a rotatable axle 46 extending parallel to the axle 54 of the hinge 24, 54. The axle 46 is thus also perpendicular to the plane of the drawing in the Figure. The axle 46 holds a tappet 48 forming a single piece with the axle 46. The tappet 48 is drivable via a coupling mechanism (not shown) which couples the tappet 48 to an electric motor arranged in the hand piece. A spring 58 is arranged near the axle 46 of the tappet, a lower end of the spring 58 being attached to the mounting frame 14, and an upper end contacting a protrusion 50 of the attachment 18. The protrusion 50 protrudes horizontally into the interior of the attachment 18. The spring 58 forces the bottom surface of the protrusion 50 to remain in firm contact with the top surface of the tappet 48 as it rotates. The tappet 48 has an elliptic transverse profile so as to lift (FIG. 5*b*) the protrusion 50 and, with it, the attachment 18 with respect to the mounting frame 14 twice during each revolution. The spring 58 thus expands and contracts as the tappet 46 rotates. The overall motion imparted to the attachment 18 by the rotating tappet 48 is a back-and-forth rotation of a few degrees, preferably between 2° and 4°, about the axis defined by the axle 54 of the hinge 24, 54. The attachment 18 thus pivots about the axis defined by the axle 54 of the hinge 24, 54. Since the rotational angle of the attachment 18 with respect to the mounting frame 14 remains small (below 4°), the back-and-forth rotational motion (i.e. the pivoting) of the attachment is experienced by a user as a vibration. It is this vibration that produces an anaesthetizing effect on the skin. It is noted that, in contrast to the embodiment described with reference to FIGS. 4*a* and 4*b*, the attachment 18 does not need to be elastic to achieve the vibrational effect.

Figure 6:
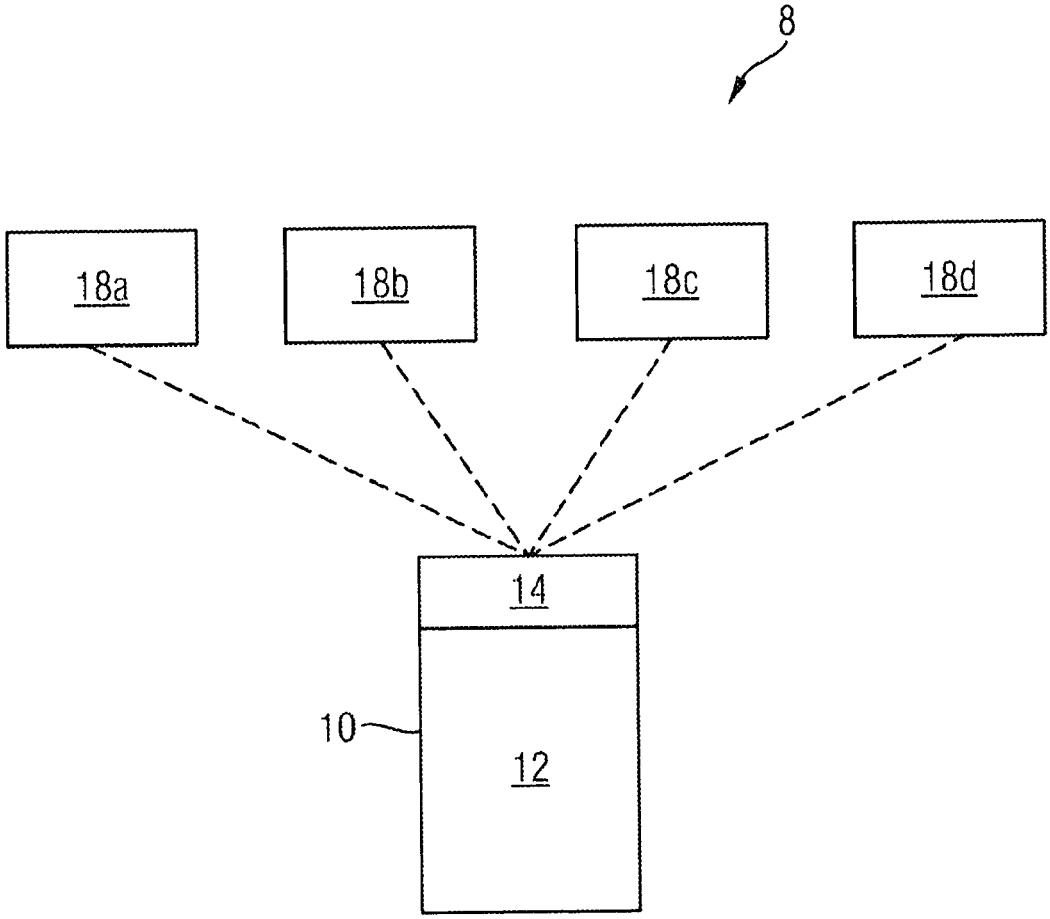
FIG. 6 schematically illustrates a system comprising an epilating unit and a set of four interchangeable attachments.

FIG. 6 schematically illustrates an epilator 8 comprising an epilating unit 10 and a set of four different interchangeable attachments 18*a*, 18*b*, 18*c*, and 18*d* as described with reference to FIGS. 3*a-d*. The attachments are a Vibrating Cap 18*a*, a Starter Cap 18*b*, a Sensitive Cap 18*c*, and a Peeling Cap 18*d*, respectively. The epilating unit 10 comprises a hand piece 12 and a detachable mounting frame 14 holding an epilating member (not shown). The attachments 18*a*, 18*b*, 18*c*, and 18*d* have mutually identical means for removable fixation to the mounting frame 14 of the epilating unit 10, which makes them easily interchangeable for a user of the system 8. The epilator 8 further preferably comprises a Massaging Cap (not shown) and/or any other suitable cap having means for removable fixation to the mounting frame 14, which means are identical to those for the attachments 18*a*, 18*b*, 18*c*, and 18*d*. For example, the epilator may further include a Protective Cap which entirely covers the epilating member and merely serves to protect the epilating unit 10 when it is not used. The epilator 8 thus provides several different functions that can be selected by the user without his or her having to exchange the epilating member.

While the invention has been illustrated and described in detail in the drawings and in the foregoing description, these drawings and the description are to be considered as examples and are not limiting. The invention is not limited to the disclosed embodiments.

Use of the verb "comprise" and its conjugations does not exclude the presence of steps or elements other than those stated in the claims. Use of the indefinite article "a" or "an" does not exclude a plurality of steps or elements. It is also noted that a single unit may provide the functions of several means mentioned in the claims. The mere fact that certain features are recited in mutually different dependent claims does not indicate that a combination of these features cannot be used to advantage. Any reference signs in the claims shall not be construed as limiting the scope.

The invention claimed is:

1. An epilator comprising:

a hand piece having a driver;

a mounting frame having a tappet, a rotatable axle coupled to the tappet for being driven by the driver to rotate the tappet, and at least one hinge mount positioned parallel to the rotatable axle;

an epilating member; and an attachment including a cover having opposing first and second parallel walls at its opposite edges, the attachment removably mounted to the mounting frame, the first wall having at least one hinge axle for attaching to the at least one hinge mount, the cover comprising a skin contact surface for defining a position of the skin relative to the epilating member when the attachment is mounted onto the mounting frame, and the second wall including a coupling element for coupling to the tappet, wherein the attachment pivots about the hinge mount when the coupling element is moved by rotation of the tappet to vibrate said attachment.

2. The epilator as claimed in claim 1, wherein the at least one hinge axle is positioned opposite the coupling for removably engaging the at least one hinge mount.

3. The epilator as claimed in claim 1, wherein the attachment comprises an elastic part to be deformed by the driver and to deform the skin contact surface during a first phase of a driving cycle and to relax during a second phase of the driving cycle and to respectively relax the skin contact surface.

4. The epilator as claimed in claim 1, wherein the tappet is an eccentric rotatable tappet.

5. The epilator as claimed in claim 1, wherein the attachment is an injection-molded part.

6. The epilator claimed in claim 1, wherein the at least one hinge mount is a snap mechanism, reversibly detachable from the attachment.

7. The epilator as claimed in claim 1, wherein the attattachment comprises a plurality of interchangeable attachments and the skin contact surfaces of the plurality of attachments differ in elasticity.

8. The epilator as claimed in claim 1 , wherein the attachment comprises a plurality of interchangeable attachments and the skin contact surfaces of the plurality of attachments differ in texture.

9. The epilator as claimed in claim 1 wherein the attachment comprises a plurality of interchangeable attachments and the skin contact surfaces of the plurality of attachments differ in shape.

10. The epilator as claimed in claim 1, wherein the attachment comprises a plurality of interchangeable attachments, the skin contact surface of at least one attachment comprises an array of protrusions, and the skin contact surface of another attachment does not comprise any protrusions.

11. The epilator as claimed in clam 1, wherein the skin contact surface of the attachment covers the epilating member at least partially.

12. The epilator as claimed in claim 1, wherein the skin contact surface of the attachment surrounds the epilating member.

13. The epilator claimed in claim 1, wherein the skin contact surface of the attachment is arranged on one side of the epilating member.

14. The epilator as claimed in claim 1, wherein the skin contact surface of the attachment has rough texture for peeling skin.

* * * * *